United States Patent [19]

Hotchkiss et al.

[11] 3,946,850

[45] Mar. 30, 1976

[54] INDEXING MEANS FOR DONOR ROLL

[75] Inventors: Stuart E. Hotchkiss, Dallas; Reginald H. Fowler, Richardson, both of Tex.

[73] Assignee: Xerox Corporation, Stamford, Conn.

[22] Filed: Apr. 12, 1974

[21] Appl. No.: 460,319

[52] U.S. Cl. ..... 197/1 R; 101/DIG. 13; 346/74 ES

[51] Int. Cl.[2] ..... B41J 27/16

[58] Field of Search ..... 197/1 R; 101/DIG. 13; 346/74 ES; 178/30

[56] References Cited

UNITED STATES PATENTS

| | | | |
|---|---|---|---|
| 1,602,757 | 10/1926 | Dorsey | 197/71 UX |
| 3,387,558 | 6/1968 | McClain | 101/351 |
| 3,426,880 | 2/1969 | Blodgett | 197/1 |
| 3,686,676 | 8/1972 | Howell et al. | 101/DIG. 13 |
| 3,686,678 | 8/1972 | Robbins et al. | 346/74 ES |
| 3,717,880 | 2/1973 | Howell | 101/DIG. 13 |
| 3,811,766 | 5/1974 | Robinson, Jr. | 346/74 ES |

*Primary Examiner*—Clyde I. Coughenour
*Assistant Examiner*—R. E. Suter

[57] ABSTRACT

A dual speed electrostatic printer having a displaceable printing stylus adapted on one position to provide maximum visibility of the characters being printed and in a second position to provide maximum printing speed and minimum interference with the developing apparatus, together with drive means to index the toner bearing donor roll to present fresh donor roll surface.

1 Claim, 5 Drawing Figures

INDEXING MEANS FOR DONOR ROLL

This invention relates generally to a recording apparatus and specifically to a recording apparatus to an improved dual speed recording apparatus.

Ever since the advent of electrography, or the act of placing electrostatic charges on an insulating recording medium using conductive electrically biased electrodes or styli and rendering these charges visible, efforts have been directed to finding applications to which this new art could be put. Such endeavors produced high speed computer printer terminals, communications printers, label printers, facsimile machines and many special purpose apparatus where the advantages of electrography were essential.

One application which has not yet been exploited is that of a very low speed printer which is capable of competition with the conventional office impact typewriter. Workers in the electrographic arts attribute this failure to many different reasons. But one reason which is generally cited in common is the present inability to meet the condition of instant visibility of the printed information.

By "instant visibility" it is meant that as a single alphanumeric symbol or character is recording in the form of a latent electrostatic image or pattern it is developed or rendered visible before or during the recording of another character. This capability is critical to the success of any keyboard input printer terminal since the operator is most desirous of "seeing" what he or she is "typing". The desire stems from both an operational need, viz., to detect errors, and a psychological need, viz., to occupy the eyes when entering information via the keyboard from a written message. The second need can be better appreciated when it is considered that by nature a keyboard operator is unaccustomed to typing without a visual indication of the results of this operation. By the term "typing" it is meant to select and depress or otherwise actuate a key on a keyboard for purposes of information recording or transmission.

Conventional impact typewriters accommodate the aforementioned needs of the typist by moving a carbon or inked ribbon up and into position between the paper and type piece for recording and then returning the ribbon down to a position which does not obstruct the typist's view of the last recorded character.

However, the electrographic process necessitates development of the electrostatic charge pattern which is required to render the recorded character optically discernible. Conventional developing techniques are all available to effect such development, however, the prior art mechanical forms by which these techniques are implemented do not lend themselves to allow viewing each developed character after it is recorded electrographically.

One technique for providing "instant visibility" places the image developing means, such as developer brush in close proximity to the path followed by the recording stylus. This is with the intent that as soon as a line is finished, the developer brush may immediately be brought into play to develop, i.e., render visible, the line just imaged. However, printing in this manner is relatively slow and time consuming, particularly where a high speed source of information such as a computer is to be printed. Indeed, not only is the aforedescribed "instant visibility" technique slower, but the close juxtaposition required between the printing stylus and the developing brush to provide "instant visibility" often results in interference and contact between the stylus and the brush during printing movements of the stylus. This in turn requires that the stylus be displaced more slowly if damage and dust are to be avoided rendering this technique more unsuited to high speed printing.

Therefore, it is an object of the present invention to provide an improved electrostatic recording apparatus.

Another object of the present invention is to provide novel stylii arrangement designed to facilitate rapid development of the line images without interference by or delay because of stylii movement.

It is a further object of the present invention to provide an improved support for the printing stylus of an electrostatic type recorder designed to enhance recorder processing speeds.

It is an object of the present invention to provide an improved dual mode recording apparatus capable of relatively low speed printing with attendant instant visibility or high speed printing of electronic data.

It is a further object of the present invention to provide a new and improved carriage support for the stylus of an electrostatic recorder.

It is a further object of the present invention to provide an improved apparatus for replenishing developer material used in developing the images printed.

This invention relates to a recording apparatus, adapted for dual speed recording, the combination including, a recording stylus for generating electrical charge patterns corresponding to images to be reproduced on a recording medium; means supporting the stylus for movement across the recording medium to image in line by line fashion; drive means to move the stylus back and forth across the medium to form an image line and then return the stylus for start of a new line; means to index the recording medium one line at a time; an image developing brush for developing the image charge patterns, the brush cooperating with the recording medium to form a preset developing zone; and means supporting the stylus for movement between a relatively low speed recording position within the developing zone of the brush to thereby enable the image charge patterns to be viewed instantly on development and a relatively high speed recording position without the developing zone of the brush to thereby permit printing movement of the stylus without interference by the developing brush.

The invention further relates to an electrostatic recording apparatus, the combination of, a developing member adapted when actuated to bring marking material into developing relationship with latent electrostatic images formed on an imaging member, a movable donor member adapted to bear marking material on the periphery thereof and engageable with the developing member to replenish marking material removed from the developing member through developing of the latent images, means for actuating the developing member to develop the images with marking material, and means responding to actuation of the developing member to move the donor member through a predetermined arc whereby to bring a fresh portion of the donor member periphery into replenishing position for engagement by the developing member.

Other features and advantages of the present invention may become more apparent from reading the following detailed description in connection with the appended drawings wherein.

Figure 1:
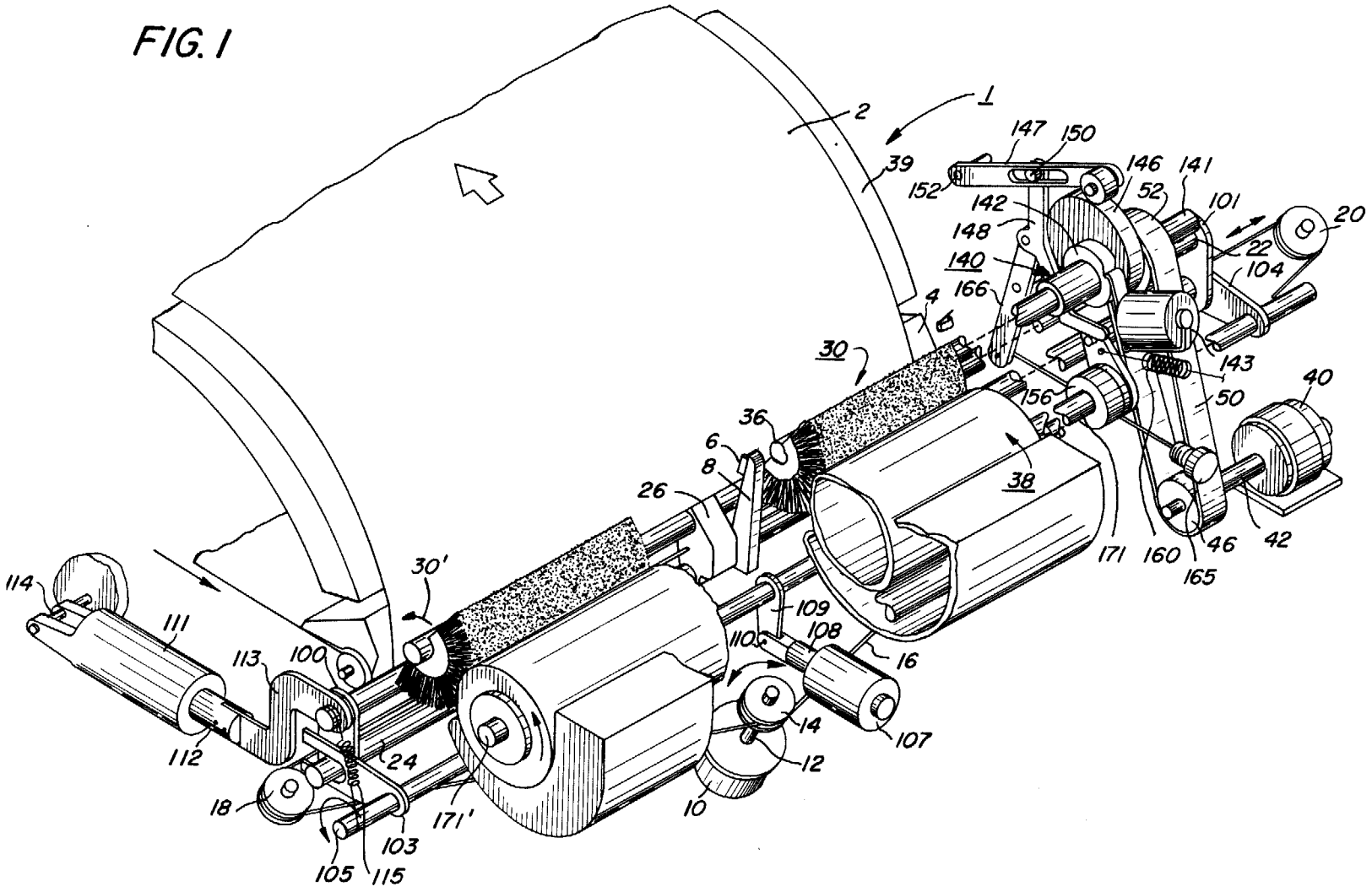
FIG. 1 is a perspective view of one embodiment of the present invention with broken away portions in an electrographic printer.
Figure 2:
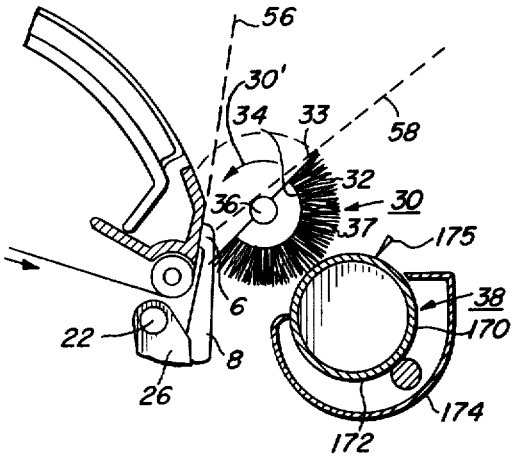
FIG. 2 is a cross-sectional view of the present invention showing the printing stylus in the low speed printing mode.

Reference will now be made to FIGS. 1 and 2 which illustrate one embodiment of the present invention as it could be incorporated in an electrographic recorder or printer 1. Since the mechanical details of printer 1 form no part of the present invention, a complete printer is not illustrated but only those parts necessary to show the advantages and utility of the present invention.

As is well known, electrography may be defined as the deposition of electrostatic charge on an insulating medium in a configuration corresponding to an electrode suitably biased. The electrode may be in contact with the medium or spaced therefrom during this deposition. The insulating medium may be constituted by a plastic-coated paper, predried paper, or any other dielectric sheet having a sufficiently high resistance to hold an electrostatic image at least until development is completed.

Such a recording medium designated by reference numeral 2 is shown in FIGS. 1 and 2 as supported in a recording zone generally by a backing electrode or support member 4 which holds the recording medium against contact by an electrographic stylus array, herein stylus 6, as it traverses the recording zone.

This array is not shown in detail but may include a liner configuration of parallel conductive electrodes suitably isolated electrically from one another. It may be mounted in or on insulative support 8 through which electrical conductors may be provided to supply electrical recording signals individually to each stylus. Support 8 is in turn mounted on movable carriage assembly 26. These electrical conductors may terminate at any suitable place on the carriage assembly in the form of a socket or other type of electrical connection to facilitate connection to a source of recording signals such as a character generator.

This technique is well known in producing alphanumeric recordings where each symbol or character is composed of selected areas from a matrix of areas. For example, a five by seven matrix may be employed while a larger matrix may also be useful depending upon the quality of recorded symbols desired.

Figure 3:
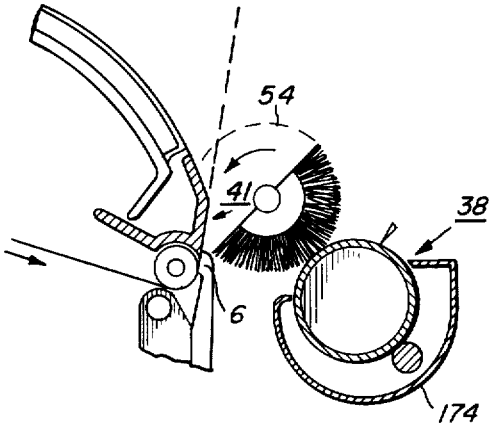
FIG. 3 is a cross-sectional view of the present invention showing the printing stylus in the high speed printing mode.

As will appear, the stylus 6 is arranged to traverse back and forth across the recording medium at one of two levels, the raised or low speed position shown best in FIG. 2 or the lowered or high speed position illustrated in FIG. 3. In the aforementioned low speed position, the stylus 6 is disposed within the developing zone or area of brush 30 permitting individual characters, or groups of characters, or even a complete line to be developed for viewing by the operator. As will appear, the flat portion 33 of developer brush 30 permits viewing of the line being printed if desired.

In the aforementioned high speed position, the stylus 6 is disposed below the developing zone or area of brush 30, and development of the characters so printed must await advancement of the recording medium 2 through the development zone of brush 30 and into the operator's viewing area. On the other hand, in the low speed position of stylus 6, rotation of brush 30 provides immediate development of the electrostatically charged areas rendering the printing visible substantially immediately.

The traversing motion of the stylus 6 is provided by a suitable servo motor 10. Motor 10 is drivingly coupled to shaft 12 and drive pulley 14 affixed thereto to move stylus 6 back and forth across the recording medium as will appear herein. The operation of motor 10 is controlled by appropriate signals, the origin of which will be described in more detail hereinafter. The drive pulley 14 has a cable 16 attached thereto, cable 16 extending over idler pulleys 18 and 20 and serving to translate the driving force of the motor 10 to the stylus support 8. Stylus support 8 is carried on a carriage assembly 26 which in turn is slidably mounted on a pair of guide shafts 22 and 24 which pass through the carriage assembly 26. As shown through the broken away portions of FIG. 1, the carriage assembly 26 is attached to opposite ends of the cable 16.

In the printing operation, the carriage assembly 26 including stylus 6 is moved from left to right (as seen in FIG. 1) across the recording medium 2 during which suitable recording signals are applied to the stylii themselves. The stylus 6 is moved in predetermined increments one character space at a time to record the characters on the electrographic recording medium 2 in the form of a latent electrostatic charge patterns. The recording medium 2 is preferably stationary in the recording zone during the left-to-right traversal of the stylus, during which an entire line of characters may be recorded. The recorded information, in the form of the alphanumeric shaped electrostatic charge patterns are rendered visible by depositing electroscopic marking particles or toner on these patterns. This is accomplished by a developing applicator such as developer brush 30.

As shown in FIGS. 1 through 3, brush 30 includes an applying member 32 which preferably comprises rabbit fur mounted on a support 34. Support 34 is in turn affixed to a shaft 36. The applying member 32 is shown to have a cylindrical developing surface 37 which extends between the left and right portions of the recording zone.

This developing surface of brush 30 is loaded with conventional electroscopic marking particles, commonly referred to as toner, by donor roller 38. As will appear donor roll 38 is rotated incrementally with each rotational cycle of brush 30 to present a fresh surface to brush 30.

The part cylindrical developing surface 37 has as its center of radius the shaft 36 which supports the developer brush 30 for rotation during the development cycle. The necessary rotative force applied to shaft 36 is provided ultimately from a suitable motor 40, the drive shaft 42 of which is suitably coupled to a drive pulley 46 affixed to shaft 42. A timing belt 50 is entrained on the drive pulley 46 and pulley 52 to which is affixed the clutch shaft 141. Clutch 140 selectively couples drive shaft 141 to brush shaft 36. By engaging clutch 140, brush 30 is rotated in the direction of the arrow 30' so as to move the developing surface 37 into contact with the recording medium 2 at the recording zone. This is shown with reference to the broken line 54 which illustrates the volume developed or swept out by the developer brush rotation.

Figure 5:
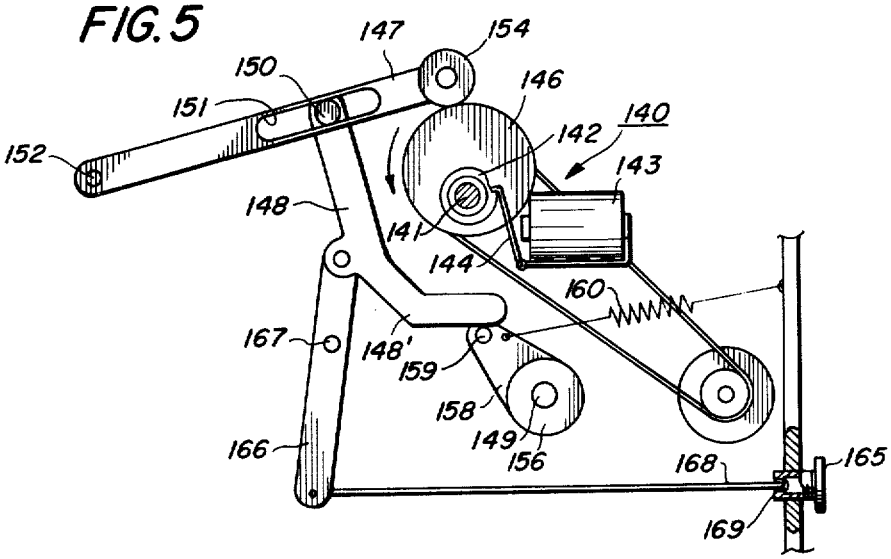
FIG. 5 is a side view showing details of the drive mechanism for indexing the donor roll in the developing apparatus of the present invention.

Referring now particularly to FIGS. 1 and 5 of the drawings, clutch 140 comprises a conventional wrap spring type clutch having an externally toothed control ratchet 142. As will be understood by those skilled in the art, the clutch coupling spring, i.e., the wrap spring, is coiled into engagement with the clutch shaft 141. The terminus of the spring is secured to ratchet 142 which is rotatably supported with driven shaft 141. The other end or terminus of the clutch spring is coupled directly to the driven shaft, i.e., brush shaft 36. When it is desired to disengage the clutch, ratchet 142 is braked to a stop, causing the clutch spring to unwind and uncouple clutch shaft 141 from brush shaft 36.

To brake ratchet 142, a clutch control solenoid 143 is provided, pawl 144 thereof being disposed in operative relationship with the external tooth of ratchet 142. Energization of solenoid 143 retracts pawl 144 to free ratchet 142 and engage clutch 140.

To index donor roll 38 from time to time to provide toner to brush 30, an eccentric 146 is rotated with brush shaft 36. A drive linkage consisting of cam follower link 147 and cooperating actuating link 148 drivingly couple eccentric 146 to drive shaft 149 for donor roll 38, link 147 being connected to link 148 via pin and slot connection 150, 151, respectively. Link 147 is pinned at 152 to an adjoining machine frame portion. Link 148 is carried by adjusting link 166 which in turn is pinned at 167 to the machine frame. Follower 154 on cam link 147 rides against the periphery of eccentric 146.

A suitable one way clutch, such as pawl and ratchet clutch 156, serves to drivingly couple input shaft 149 to donor roll end shaft 171. A drive link 158 is provided on input shaft 149. Drive pin 159 on link 158 drives leg 148′ of actuating link 148, spring 160 serving to maintain the cooperative links in driving engagement with one another.

In operation, rotation of brush shaft 36 results in commensurate rotation of eccentric 146. Rotation of eccentric 146 moves follower link 147 to pivot actuating link 148 which in turn rotates, via clutch 156, donor roll 38 through a pre-set arc.

The degree of rotation of donor roll 38 may be advantageously controlled by means of a manually operated knob 165 operatively connected to adjusting link 166 through rod 168. Knob 165 is coupled to rod 168 as by threads 169 such that rotation of knob 165 works, via rod 168, to displace the pivot point of actuating link 148 and thus the arc through which actuating link 148 turns.

As best seen in FIGS. 1 and 2, donor roll 38 comprises a hollow metal cylinder 170 having end shafts 171, 171′ for rotatably supporting roll 38 in the printer frame (not shown). The outer periphery 172 of cylinder 170 bears a thin coating of tribo-electric enhancing material such as polymethyl methracralate. Donor roll 38 is partially immersed in toner within toner supply hopper 174. A flexible wiper blade assembly 175 serves to remove excess toner from the surface of roll 38.

In operation of the developing brush, toner is loaded onto the applying surface of brush 30 via donor roller 38 and is retained by tribo-electric attraction to be conveyed during the rotation of the applicator to the developing zone 41. At the developing zone 41 the toner is attracted by and deposited on the latent electrostatic charge patterns placed on the recording medium 2 by the action of the stylus 6 in cooperation with the recording signals.

As the brush 30 moves toward its developing position, which can be considered as that position when its applying surface 37 is in contact with the recording medium in the recording zone, it is loaded with toner by the donor roller 38. The position of brush 30 in FIGS. 1 through 3 is in a non-developing position, or what may be referred to as a viewing position. Since the non-developing surfaces of the brush 30 is substantially planar and passes through the axis of the shaft 36, the user may directly see the recording zone without any portion of the applying member 32 obstructing his line of vision.

The non-developing surface of developer brush 30 has been referred to a planar, but more specifically it may include two planar surfaces not necessarily coplanar. Each of these surfaces extend from the shaft 36 of the brush 30. If the developing surface subtends at an angle of 180° relative to the axis of rotation of the brush, then these two planar surfaces would lie in the same plane through this axis. However, if the developing surface subtends an angle less than 180° then this non-developing surface is actually composed of two planar surfaces which are not coplanar.

In the low speed printing mode seen in FIG. 2, the viewing position of the developer brush 30 is important since it is by reason of the configuration of the brush that immediate visual accessibility of the developed information is possible. Therefore, the viewing position should be further defined in terms of a viewing angle. As hereinabove described, the backing electrode or support 4 provides support to the recording medium 2 in a recording zone so that the stylus 6 may be moved through the recording zone and uniformly with the recording medium thereat. This means that the recording zone is substantially defined by the distance between the uppermost and lowermost stylii in the linear array of stylus 6 and by the margins of the recording information. Therefore, for example, if the alphanumeric symbols to be recorded have a maximum height of one tenth of an inch and the recording medium is approximately 8½ inches wide, then the recording zone will be approximately one tenth of an inch by a little less than 8½ inches.

In order to insure uniform quality in the recorded characters, it is preferable that the backing support 4 be such as to provide a substantially flat surface at the recording zone upon which the recording medium may rest. Therefore, the latent electrostatic charge patterns recorded on the medium 2 by the moving styli can be considered to lie in a predetermined plane which is, in effect, a function of the position and configuration of the backing support 4. Hence, if this support 4 is substantially flat, all the electrostatic charge patterns recorded during one traversal of the carriage assembly 26 will lie in the same plane. Consequently, the viewing angle may be defined by an imaginary line (broken line 56 in FIG. 2) passing through the plane of the recording zone which is, in effect, the plane occupied by the last recorded symbols on the medium 2 and which is substantially perpendicular to the direction of traversal of the stylus 6 and a line (broken line 58 in FIG. 2) extending from the lower extremity of a recorded character in the recording zone and passing in close proximity to the uppermost portion of developer brush 30 in its viewing position. Stated another way, this second line 58 starts at the lower edge of the recording zone and extends over the top of the brush 30 and as close to it as it can be and still remain straight. As shown in this figure, the viewing angle is approximately 45°. Of course, for a greater angle, it may be desirable to reduce shaft 36 to a semi-circular cross-section.

After development, the toner may be fixed to the recording medium in any of several conventional manners. For example, recording medium support and guide member 39 may house a platen fuser employing a resistance heating coil over which the medium is moved.

Figure 4:
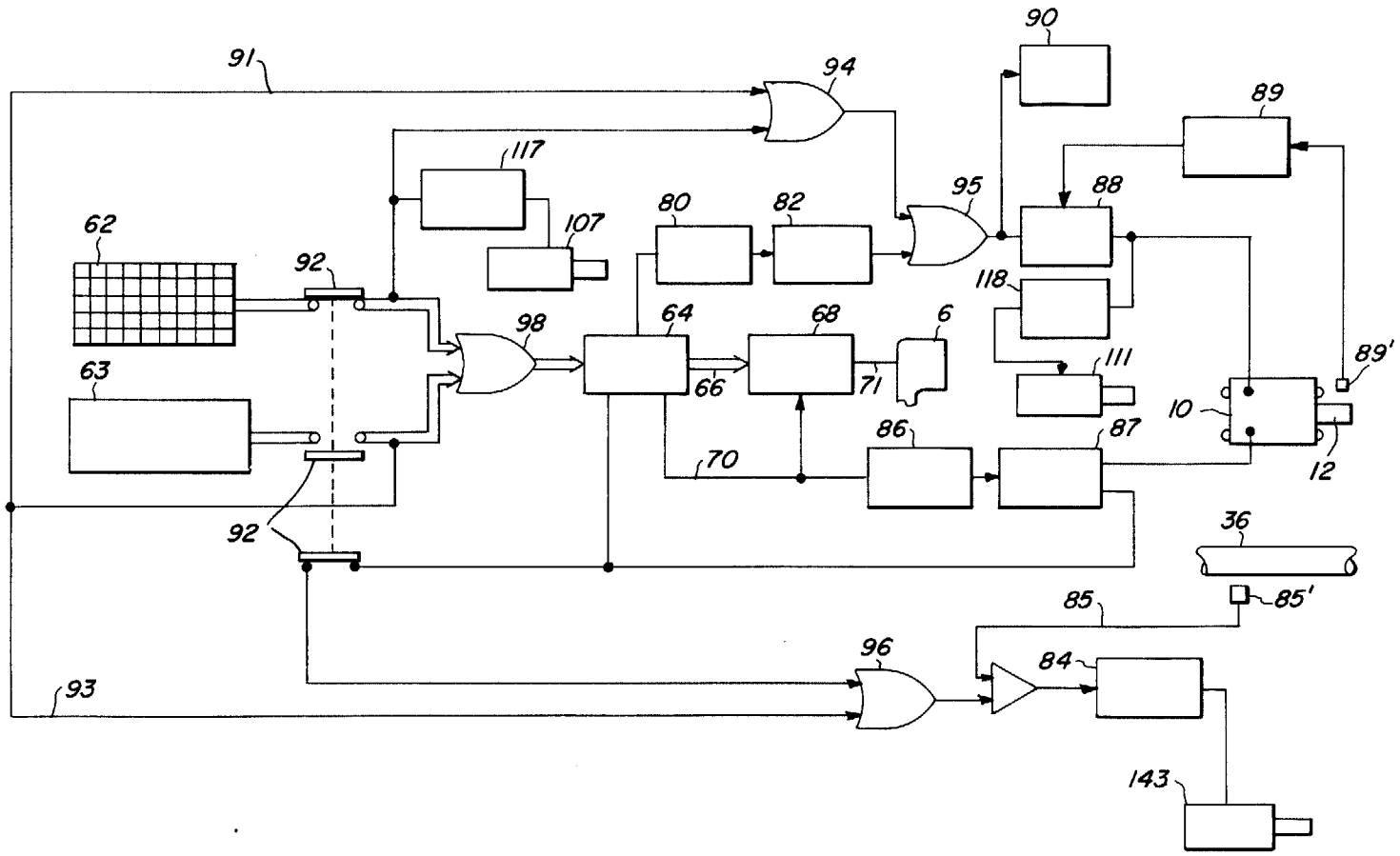
FIG. 4 is a block schematic of the control system for the present invention.

Having described the mechanical structure of the printer 1, the control circuit therefor will be described with reference to the schematic of FIG. 4. The input to printer 1 for the low speed printing mode may, for example, comprise a conventional keyboard 62 which may generate an appropriate binary code uniquely identifying the alphanumeric symbol corresponding to the actuated key of this keyboard. For high speed printing, the input may comprise a computer 63.

The binary code, such as used in the American Standard Code for Information Interchange, is provided to the input of a suitable decoder control circuit 64 which decodes the binary code to generate a character pulse on one of a series of parallel outputs indicative of the alphanumeric symbol selected at the keyboard 62 and integrates printing operation of stylus 6 with movement thereof along the recording medium, and in the low speed position, operation of developing brush 30 to develop the character just printed. Output conductor 66 is intended to represent a number of outputs each of which would correspond to a separate alphanumeric character in the particular alphabet incorporated in the keyboard 62 or computer 63 while conductor 70 represents the operational control signal.

The outputs of conductor 66 collectively provide one input to a character generator 68 which may take various conventional forms. As an example only, generator 68 may consist of a diode matrix having a number of character select input wires which corresponds to the outputs of the decoder circuit 64. These wires are selectively coupled to readout wires via diodes which are forward biased when their respective character select wire is energized. Another form which the character generator may take is a magnetic core matrix, having five columns and seven rows, wherein a particular character select wire associated with one of the outputs 66 intertwines an appropriate pattern of magnetic cores corresponding to the alphanumeric symbol to be recorded. The character generator as well as the other parts of the block diagram of FIG. 4 are not intended to form a particular part of the present invention per se and therefore are shown schematically only since well known conventional circuits may be used to provide their functions.

The control signal output from decoder 64 in conductor 70 identifies decoding of a binary code by the decoder. In this manner, for each character entered at the keyboard 62 which effects a decoding process in the decoder 64, a control signal normally in the form of a pulse or series of pulses will be generated in conductor 70. This signal pulse to the character generator 68 actuates, for example, in the case of a magnetic core matrix, a distributor circuit to sequentially read out each column of the core matrix at a rate correlated to the speed of the styli movement. As each column is sampled by the distributor circuit, a group of parallel outputs would be energized depending on the cores set by the character select wire. The signals on these parallel outputs would be supplied to a suitable drive stage which would provide recording signals to the styli via output conductor 71.

The control signal pulses in conductor 70 also serve to pulse motor 10 in the forward or recording direction via forward drive control circuit 86. The motor 10 works through drive belt 16 to move the stylus 6 in the recording direction the equivalent of one character space, subject to any delay imposed by circuit 87. Delay circuit 87 is relied on to maintain stylus 6 in place for a sufficient time for the stylii to place a symbol on the recording web before the stylus is moved.

In the low speed printing mode, development takes place on a character-to-character basis to enable the user to see the character printed immediately. Following completion of each character, a signal pulse from circuit 87 actuates developer control circuit 84 to energize solenoid 143 and engage clutch 141. Clutch 140 couples motor 40 via belt 50 to developing brush 30 to initiate rotation of brush 30. Circuit 84 maintains solenoid 143 energized, and brush 30 rotating for a sufficient duration, normally one revolution, to develop the character just printed. Following rotation of brush 30 through the requisite developing cycle, a stop signal is generated in conductor 85 to a de-energize solenoid 143 and stop rotation of brush 30. At the same time, printing of the next character is enabled. The aforesaid stop signal may be generated by means of a suitable optical type encoder 85' on shaft 36 of brush 30, it being understood that the stop signal in conductor 85 reflects return of brush 30 to the position shown in FIG. 2 permitting the operator to view the character just printed.

Signal pulses from decoder 64 in conductor 81 drive a suitable counter 80. The signal from counter 80 indicates when a predetermined maximum number of characters representing one line have been decoded by decoder 64. For example, where the recording web 2 will accommodate eighty characters per line, counter 80 would provide a signal output when a count of eighty has been reached. The signal output of counter 80 may be suitably delayed as by delay circuit 82 for the time necessary to allow the line to be completed.

The end of the line signal from counter 80 triggers motor reverse control circuit 88 to operate motor 10 in the reverse direction and return stylus 6 to the start of line position as determined by stylus position responsive circuit 89. Circuit 89 includes a suitable pickup 89' responsive to the position of carriage 26, such as an optical encoder on the output shaft 12 of motor 10, which identifies the line start position.

The signal from counter 80 may also be used to actuate recording medium advance circuit 90 to advance or index the recording medium 2 one line. For use in the low speed printing mode, keyboard 62 preferably includes a suitable carriage return key which may be used by the operator to trigger via OR type circuits 94, 95, circuits 88, 90 directly to return stylus 6 to the start of line position and index the recording medium one line. As will be appreciated, an index signal via conductor 91 from computer 63 also triggers circuits 88, 90 as where the line being printed is less than the maximum number of characters responded to by counter 80.

To provide either high or low speed printing modes, a suitable mode selector 92 is provided. Selector 92 when in the solid line position of FIG. 4 operatively couples keyboard 62 with OR type circuit 98 and decoder 64. When disposed in the dotted line position of FIG. 4, selector 92 operatively couples computer 63 with decoder 64. In this latter disposition of selector 92, binary coded signals from computer 63 to decoder 64 are printed out by stylus 6 as described heretofore. In this mode of operation, development takes place subsequent to completion of the line being printed. Since developing brush 30 and the developing zone 41 thereof are spaced from stylus 6, development may take place during return of stylus 6 to the start of line position and/or during printing of the succeeding line or lines. Conveniently, a control signal from computer 63 may be applied to developer control circuit 84 via conductor 93 and OR type circuit 96 to initiate rotation of developing roll 30 as described hereinbefore.

The guide rods 22, 24 for the stylus bearing carriage assembly 26 are carried by a pair of end plates 100, 101, the carriage support assembly so formed being in turn supported via the lower rod 24 and notched swing plates 103, 104 from base rod 105. Guide rod 22 is in turn rotatably journaled in the printer frame (not shown). Rotation of base rod 105 works through swing plates 103, 104 and guide rod 24 move stylus 6 along a preset path between the high and low speed printing modes. For this purpose, a suitable driver such as solenoid 107 is provided, plunger 108 thereof being operatively secured to base rod 105 through depending link and pin 109, 110, respectively. A suitable solenoid control circuit 117 is provided to control energization of solenoid 107 and raising and lowering of stylus 6 as will appear.

To move stylus 6 into and out of printing position adjacent recording medium 2, a second driver such as solenoid 111 is provided, plunger 112 of solenoid 111 being drivingly connected to the upper guide rod 22 via link 113. Solenoid 111 is swingably mounted on the printer frame (not shown) as by pin 114. Spring 115 serves to bias the stylus 6 away from the recording medium 2. A suitable solenoid control circuit 118 is provided for operating solenoid 111.

Upon disposition of mode selector 92 in the low speed printing mode (the solid line position in FIG. 4), solenoid control circuit 117 is triggered to energize solenoid 107. Energization of solenoid 107 raises stylus 6 from the high speed position shown in FIG. 3 to the low speed position shown in FIG. 2. Stylus 6 is now in position for low speed printing under the control of keyboard 62 as described earlier.

Upon disposition of mode selector 92 in the high speed printing mode (the dotted line position in FIG. 4), solenoid control circuit 117 is reset to de-energize solenoid 107 and permit stylus 6 to drop to the high speed printing position. It is understood that suitable return spring means (not shown) may be provided to enhance movement of stylus 6 to the high speed position.

To facilitate returning stylus 6 to the start of line position, solenoid III is energized to draw stylus 6 back from the recording medium 2 and out of recording position. The signal from gate 95 initiating energization of motor 10 in the reverse direction to return carriage 26 and stylus 6 therewith to the start of line position at the same time triggers control circuit 118 which in turn de-energizes solenoid 111. De-energization of solenoid 111 enables spring 115 to swing stylus 6 away from the recording medium 2. On completion of the carriage return stroke, solenoid 111 is energized to move stylus 6 into printing position.

While the invention has been described with reference to the structure disclosed, it is not confined to the details set forth, but is intended to cover such modifications or changes as may come within the scope of the following claims.

What is claimed is:

1. In an electrostatic recording apparatus having a developing member when actuated to bring marking material into developing relationship with latent electrostatic images formed on an imaging member and a movable donor member with marking on the periphery thereof and engageable with said developing member to replenish marking material removed from said developing member through developing of said latent images, the improvement comprising:

means for actuating said developing member to develop said images with marking material, said developing member actuating means including means for rotating said developing member to develop images on said imaging member; and, driving means for said donor member responsive to actuation of said developing member to move said donor member through a predetermined arc whereby to bring a fresh portion of said donor member periphery into replenishing position for engagement by said developing member, said donor driving means including an eccentric rotatable with said developing member, a follower riding on said eccentric, and link means drivingly coupling said follower with said donor member to move said donor member through said predetermined arc upon rotation of said developing member; said link means including one way clutch means to prevent reverse movement of said donor member and a pair of link members, one of said link members having a slot-like aperture, a drive pin on the other of said link members disposed within said aperture whereby to drivingly couple said pair of link members together, said follower being supported on said one of said link members, said other of said link members being coupled to said clutch whereby said pair of link members form a driving connection from said follower to said clutch, and adjusting means for changing the position of said drive pin in said aperture.

* * * * *